US008094085B2

(12) United States Patent
Sato et al.

(10) Patent No.: US 8,094,085 B2
(45) Date of Patent: Jan. 10, 2012

(54) CABINET OF ELECTRICAL APPARATUS AND ANTENNA APPARATUS

(75) Inventors: Kyuichi Sato, Oga (JP); Hiroshi Suzuki, Akita (JP); Kenichi Kamada, Akita (JP); Takao Kato, Oga (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 448 days.

(21) Appl. No.: 12/427,034

(22) Filed: Apr. 21, 2009

(65) Prior Publication Data

US 2010/0141534 A1 Jun. 10, 2010

(30) Foreign Application Priority Data

Dec. 4, 2008 (JP) ..... 2008-309594

(51) Int. Cl.
*H01Q 1/42* (2006.01)
*H01Q 1/32* (2006.01)

(52) U.S. Cl. ..... 343/872; 343/711; 343/713

(58) Field of Classification Search ..... 343/711, 343/713, 872, 702
See application file for complete search history.

(56) References Cited

U.S. PATENT DOCUMENTS 6,930,643 B2 * 8/2005 Byrne et al. ..... 343/702
7,091,912 B2 * 8/2006 Iacovella et al. ..... 343/713
7,333,065 B2 * 2/2008 Lindackers et al. ..... 343/713
7,492,319 B2 * 2/2009 Lindackers et al. ..... 343/713
7,710,333 B2 * 5/2010 Byrne et al. ..... 343/713

FOREIGN PATENT DOCUMENTS

JP 2000-068722 A 3/2000
JP 2005-102031 A 4/2005

OTHER PUBLICATIONS

Japanese Office Action dated Feb. 16, 2010 and English translation thereof issued in counterpart Japanese Application No. 2008-309594.

* cited by examiner

*Primary Examiner* — Hoang V Nguyen
(74) *Attorney, Agent, or Firm* — Holtz, Holtz, Goodman & Chick, PC

(57) ABSTRACT

Disclosed is a cabinet of an electrical apparatus including: a base; a cover to cover over the base; a gasket placed on a top face of the base and nipped between a bottom edge section of the cover and the base; a fastening section to penetrate through the base from a bottom face to the top face of the base to connect to an inner face of the cover and to tighten so that the base is pulled to a cover side; a seal integrally formed with the gasket to surround on the top face of the base a through hole which the fastening section penetrates; and a hood provided on an inner face of the cover so as to surround a connecting portion of the fastening section and the cover, and the hood being pressed against the seal.

4 Claims, 6 Drawing Sheets

CABINET OF ELECTRICAL APPARATUS AND ANTENNA APPARATUS

BACKGROUND OF THE INVENTION

1. Field of the Invention

The present invention relates to a cabinet of an electrical apparatus and an antenna apparatus, and in particular, a cabinet with excellent waterproof and airproof performance and an antenna apparatus.

2. Description of Related Art

In an electrical apparatus such as an antenna apparatus, etc., a circuit substrate is accommodated inside a cabinet and a circuit substrate is supported inside the cabinet. As a cabinet, there is a cabinet where a base and a cover are set together, the base is provided in a plate-shape and the bottom of the cover is open to cover over the base so that the opening of the cover is closed by the base (for example, see Japanese Patent Application Laid-Open Publication No. 2005-102031).

In order to fix the cover to the base, a screw linking section is used. In other words, a female screw is formed on the inside face of the cover and a through hole is formed on the base to pass a shaft of a male screw through the through hole to screw the shaft to the female screw (for example, see Japanese Patent Application Laid-Open Publication No. 2005-102031).

A rubber pad member is used in order to enhance the waterproof and airproof performance of the cabinet (for example, see Japanese Patent Application Laid-Open Publication No. 2005-102031). In other words, the rubber pad member covers the outer peripheral section from the bottom face of the base and the base is fitted into the opening of the bottom of the cover with the pad member set to the base. The outer peripheral section of the pad member is nipped between the bottom edge section of the inner face of the cover and the outer peripheral of the base, and thus the airproof and waterproof performance of the cabinet is enhanced.

When the pad member is used, the waterproof and airproof performance of the screw hole is maintained by the pad member (for example, see Japanese Patent Application Laid-Open Publication No. 2005-102031). In other words, the shaft of the male screw is passed through the pad member and the base from the bottom up, and the head of the male screw is caught by the bottom face of the pad member and the shaft of the male screw is screwed to the female screw of the inner face of the cover. By tightening the male screw, the pad member and the base is pulled to the cover side and the pad member is nipped between the head of the male screw and the bottom face of the base to maintain the waterproof and airproof performance of the screw hole.

However, when the male screw is tightened, the head of the male screw is pushed to the pad member and the pad member is compressed around the screw hole. When the pad member deforms in this way, the force of the base being pulled toward the cover becomes weak. Therefore, the outer peripheral section of the pad member is hardly compressed, the gap between the bottom of the inner face of the cover and the outer peripheral section of the base is not filled and the airproof and waterproof performance of the portion is reduced.

SUMMARY OF THE INVENTION

It is, therefore, a main object of the present invention to maintain waterproof and airproof performance of both the hole where a fastening section such as a male screw penetrates through and the gap between the cover and the base.

According to an aspect of the present invention, there is provided a cabinet of an electrical apparatus, including:

a base;

a cover to cover over the base;

a gasket placed on a top face of the base and nipped between a bottom edge section of the cover and the base;

a fastening section to penetrate through the base from a bottom face to the top face of the base to connect to an inner face of the cover and to tighten so that the base is pulled to a cover side;

a seal integrally formed with the gasket to surround on the top face of the base a through hole which the fastening section penetrates; and a hood provided on an inner face of the cover so as to surround a connecting portion of the fastening section and the cover, and the hood being pressed against the seal.

According to an aspect of the present invention, there is provided an antenna apparatus, including:

a base;

a cover to cover over the base;

a gasket placed on a top face of the base and nipped between a bottom edge section of the cover and the base;

a circuit substrate to be accommodated in an inner space surrounded by the base and the cover;

a fastening section to penetrate through the base from a bottom face to the top face of the base to connect to an inner face of the cover and to tighten so that the base is pulled to a cover side;

a seal integrally formed with the gasket to surround on the top face of the base a through hole which the fastening section penetrates; and a hood provided on an inner face of the cover so as to surround a connecting portion of the fastening section and the cover, and the hood being pressed against the seal.

BRIEF DESCRIPTION OF THE DRAWINGS

The above and other objects, advantages, and features of the present invention will become more fully understood from the detailed description given hereinbelow and the appended drawings which are given by way of illustration only, and thus are not intended as a definition of the limits of the present invention, wherein.

DESCRIPTION OF THE PREFERRED EMBODIMENTS

The best mode for carrying out the cabinet of the electrical apparatus and the antenna apparatus according to the present invention will be explained in detail with reference to the drawings. However, the scope of the invention is not limited by the illustrated examples.

Figure 1:
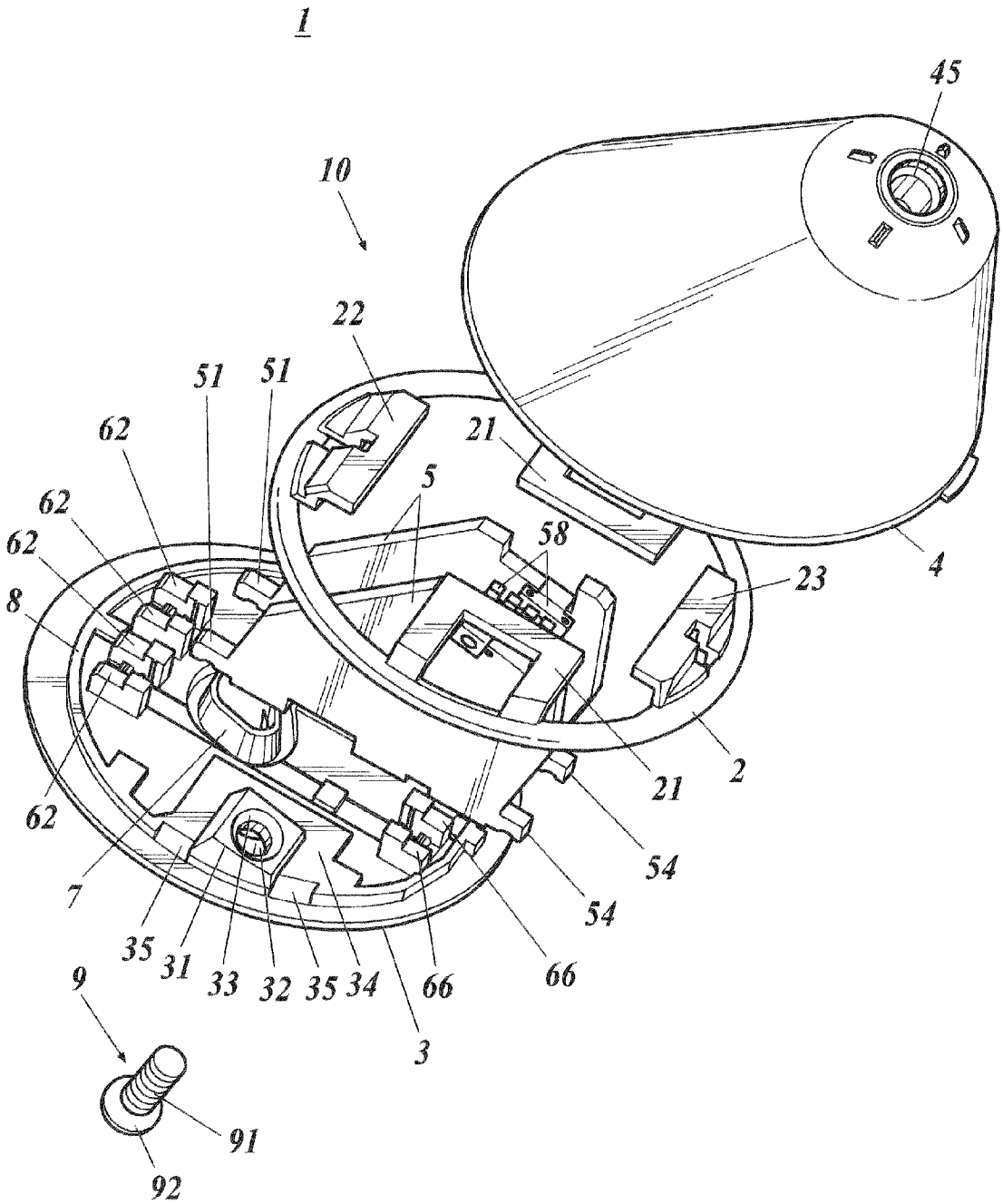
FIG. 1 is a perspective view showing an antenna apparatus of the present embodiment.
Figure 2:
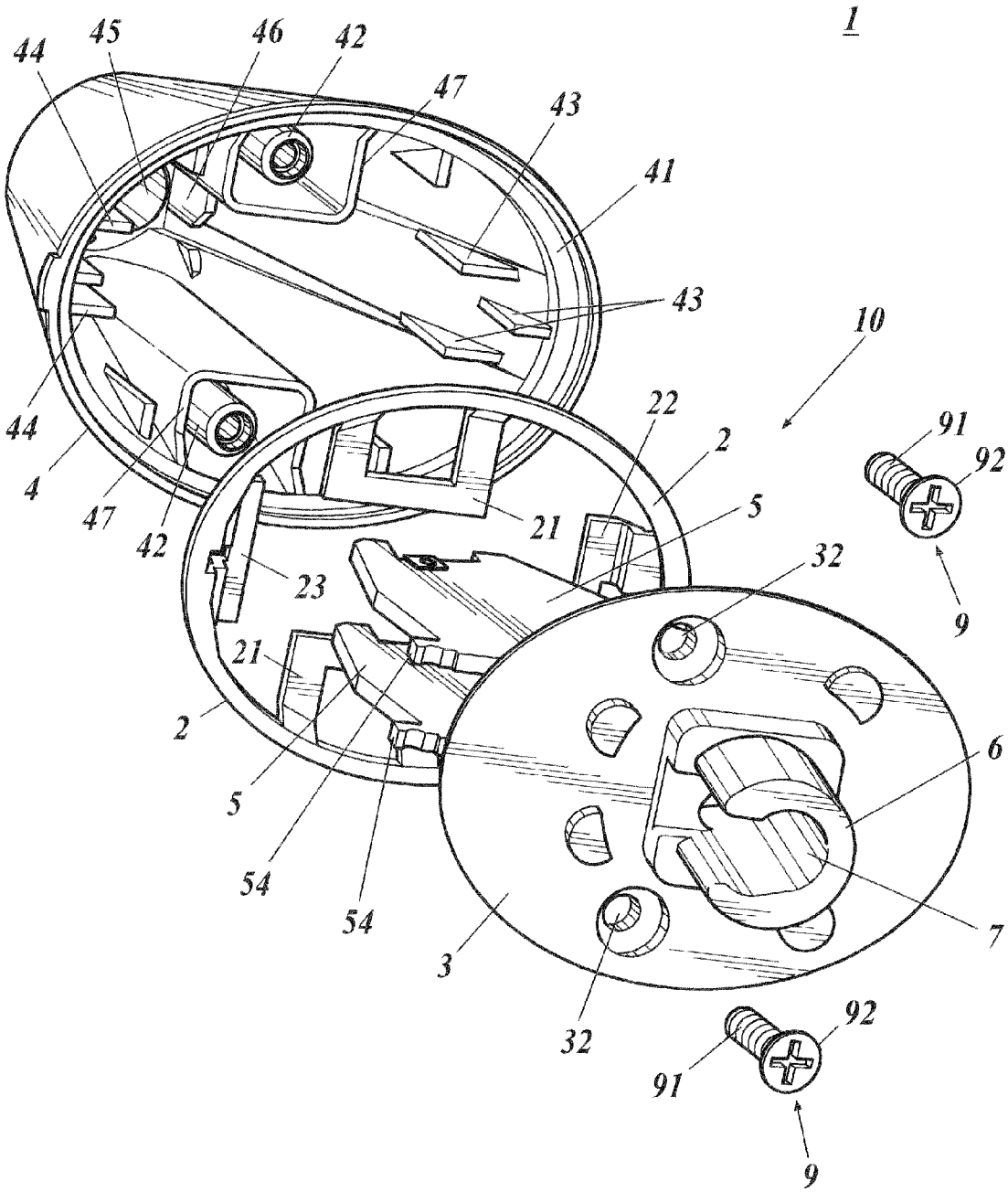
FIG. 2 is another perspective view showing the antenna apparatus of the present embodiment.
Figure 3:
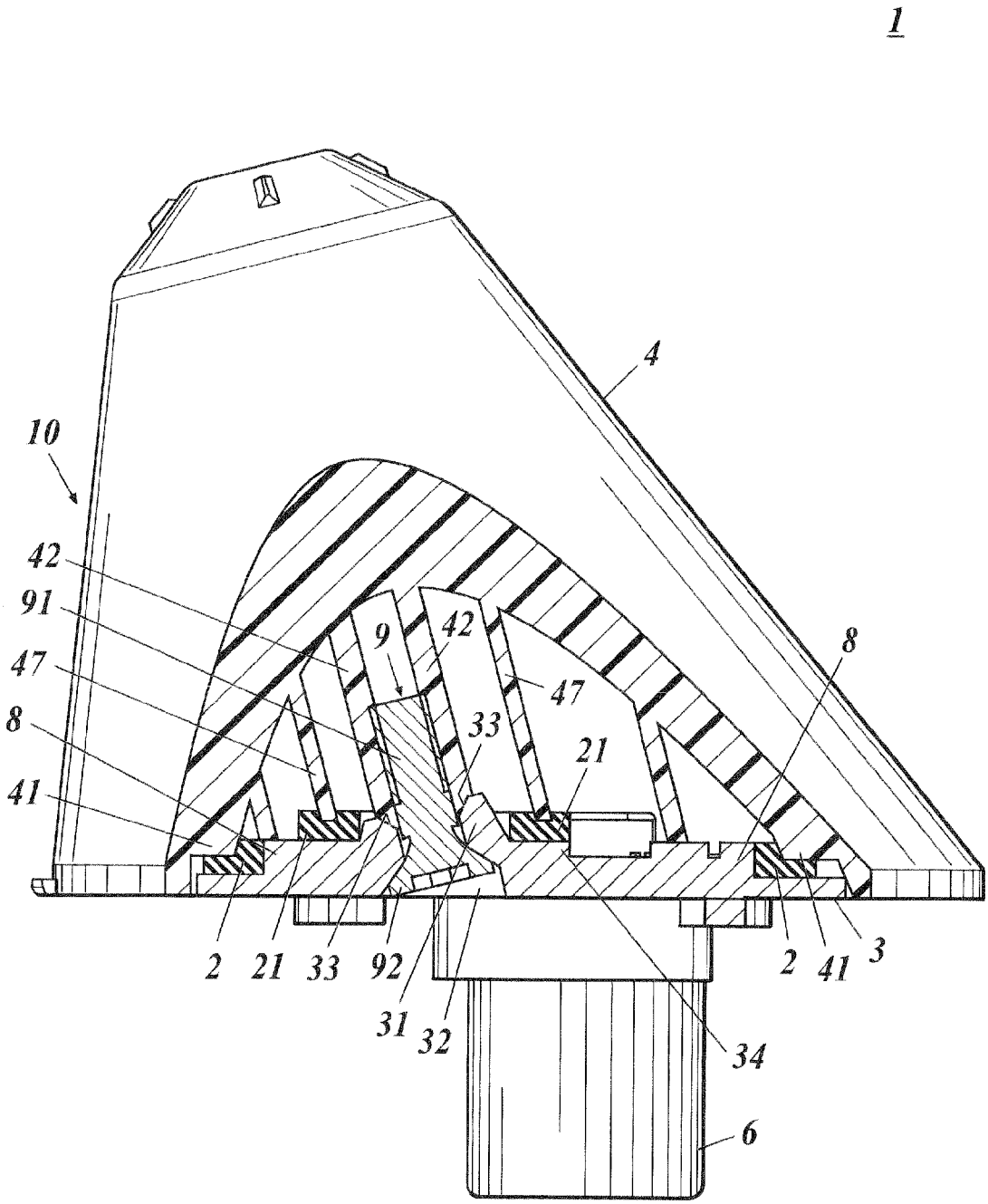
FIG. 3 is a vertical cross-sectional view showing the antenna apparatus of the present embodiment.

FIG. 1 is an exploded perspective view showing an antenna apparatus 1 from a view diagonally above, FIG. 2 is an exploded perspective view showing the antenna apparatus 1 from a view diagonally below, and FIG. 3 is a vertical cross-sectional view showing the antenna apparatus 1. The antenna apparatus 1 as an electrical apparatus is mounted on installing points such as a roof of an automobile, a roof of a vehicle, etc.

The antenna apparatus 1 includes a cabinet 10, and two circuit substrates 5, and these circuit substrates are accommodated in the cabinet 10. A branching circuit, amplifying circuit, etc. are included in the circuit substrate 5. One of the two circuit substrates 5 is an AM/FM substrate, and the other is a GSM substrate. The form/standard of the radio wave which can be processed by these circuit substrates 5 is not limited to AM/FM or GSM and can be other form/standard.

In the cabinet 10, a gasket 2 is mounted on an edge of a top face of a plate-shaped base 3, a cover 4 covers over the base 3, the rubber gasket 2 is nipped between the cover 4 and the base 3, and the cover 4 and the base 3 are joined by a fastening screw 9 which is a male screw. With this, an inner space surrounded by the cover 4 and base 3 is formed and the circuit substrate 5 is accommodated in the inner space.

The base 3 is formed in an oval shape. An inserting section 6 is convexly provided on a bottom face of the base 3, and a distribution hole 7 penetrates from a tip of the inserting section 6 through a top face of the base 3. The wiring is distributed through the distribution hole 7.

A convex section 8 is provided in a convex shape on the top face of the base 3. The convex section 8 is formed in a frame shape along the edge of the top face of the base 3. On the other hand, the gasket 2 is formed in a ring shape, and the convex section 8 is fitted to the gasket 2 so that the gasket 2 surrounds the convex section 8 to be placed on the top face of the base 3.

The base 3, inserting section 6 and convex section 8 are formed integrally. The base 3, inserting section 6 and convex section 8 are made from conductive material, in particular metallic material such as zinc.

The cover 4 is formed in a circular cone shape, and the bottom side of the cover 4 is open. A support fitting 45 is provided on the top tip section of the cover 4 and a bar-shaped antenna element is mounted to the support fitting 45.

The base 3 is fitted nesting in the opening of the cover 4 and the opening is closed by the base 3. A stepped section 41 is formed near the bottom opening on the inner face of the cover 4. The stepped section 41 is formed in a ring shape along the bottom opening of the cover 4. The gasket 2 is nipped between the stepped section 41 and the edge section of the top face of the base 3. The gasket 2 maintains the waterproof and airproof performance.

The circuit substrate 5 is accommodated in the cover 4 in a standing state on the top face of the base 3 inside the convex section 8. A pair of left and right ribs 62 is convexly provided on the front side of the top face of the base 3, and a pair of left and right ribs 66 is convexly provided on the rear side of the top face of the base 3. The front edge section 51 of the bottom edge of the circuit substrate 5 is nipped between the pair of ribs 62 and the rear edge section 54 of the bottom edge of the circuit substrate 5 is nipped between the pair of ribs 66 and with this, the circuit substrate 5 is maintained in a standing state. A pair of left and right ribs 62 makes one pair and a total of two pairs is provided and a pair of left and right ribs 66 makes one pair and a total of two pairs is provided. The two circuit substrates 5 stand on the top face of the base 3 parallel to each other.

An elastic piece 22 is placed on the front edge section 51 of the circuit substrate 5 and the pair of ribs 62. The front edge section 51 of the circuit substrate 5 and the elastic piece 22 are pressed toward the base 3 side by the pressurizing section 43 convexly provided on the inner face of the cover 4. Similarly, an elastic piece 23 is placed on the rear edge section 54 of the circuit substrate 5 and the pair of ribs 66, and the rear edge section 54 of the circuit substrate 5 and the elastic piece 23 are pressed by the pressurizing section 44 convexly provided on the inner face of the cover 4. With this, the circuit substrate 5 is fixed. The elastic pieces 22 and 23 are integrally formed with the gasket 2.

The top edge section of the standing circuit substrate 5 is supported by the supporting section 46 of the inner face of the cover 4. Also, a terminal 58 is mounted to the top edge section of the circuit substrate 5, and the terminal 58 is in contact with the support fitting 45.

A pair of left and right mounts 31 is convexly provided on the inner side of the convex section 8 on the top face of the base 3. The pair of left and right through holes 32 penetrate the base 3 from the bottom face of the base 3 to the top tip face of the mount 31. The opening of the through hole 32 on the top tip side of the mount 31 opens widening in a circular cone shape and circular cone face 33 is formed in the opening of the through hole 32. On the other hand, a pair of left and right screw fastening sections 42 is formed on the inner face of the cover 4. A cylinder shaped screw fastening section 42 extends from the inner face of the cover 4 toward the through hole 32, and the tip of the screw fastening section 42 is at a position corresponding to the through hole 32. The tip of the screw fastening section 42 is inserted in the opening of the through hole 32 on the top tip face side of the mount 31 and is in contact with the circular cone face 33 of the opening. A rubber O-ring can be attached to the tip of the screw fastening section 42 and the O-ring can be nipped between the tip of the screw fastening section 42 and the circular cone face 33.

Also, a female screw is formed on the inner face of the screw fastening section 42 by a later-described assembly method. On the other hand, the fastening screw 9 is connected to the inner face of the cover 4 through the screw fastening section 42. In other words, the shaft 91 of the fastening screw 9 is passed through the through hole 32 from below the base 3 and is screwed to the screw fastening section 42. The head 92 of the fastening screw 9 is caught by the bottom face of the base 3 around the through hole 32. The base 3 is pulled toward the cover 4 side with the head 92 of the fastening screw 9 by tightening the shaft 91 of the fastening screw 9. With this, the gasket 2 and the elastic pieces 22 and 23 are compressed. A rubber elastic body is not nipped by the head 92 of the fastening screw 9 and the bottom face of the base 3, and thus the gasket 2 and the elastic pieces 22 and 23 can be strongly compressed by the tightening force of the fastening screw 9.

When the base 3 is covered by the cover 4, the center line of the circular cone shaped cover 4 is diagonal with respect to the top face of the base 3. The center line of the screw fastening section 42 is parallel with respect to the center line of the circular cone shaped cover 4 and the shaft center of the shaft 91 of the fastening screw 9 is almost parallel with respect to the center line of the cover 4.

A raised section 34 is formed on the top face of the base 3 around the mount 31. The raised section 34 is raised from the top face of the base 3 and the height of the raised section 34 is same as the height of the convex section 8 and the raised section 34 continues to the convex section 8. Inclined faces 35 are formed on the front and the rear of the mount 31. The inclined face 35 is provided to cross the convex section 8 from the edge section of the top face of the base 3 to the top tip face of the raised section 34. The inclined face 35 is inclined to rise from the edge section of the top face of the base 3 to the top tip face of the raised section 34.

The mount 31 is surrounded by a frame-shaped seal 21. The seal 21 is provided to extend inside from the gasket 2. The seal 21 is made of rubber and is integrally formed with the gasket 2. The seal 21 is placed on the inclined face 35 crossing the convex section 8 and is placed on the top tip face of the raised section 34 surrounding the mount 31 in a state in contact with the side face of the mount 31. By fitting the mount 31 to the seal 21, the through hole 32 is also surrounded by the seal 21.

On the other hand, a pair of left and right hoods 47 is formed on the inner face of the cover 4. The screw fastening section 42 is provided in the hood 47 and the hood 47 surrounds the screw fastening section 42. The bottom side of the hood 47 is open. The mount 31 is inserted in the bottom opening of the hood 47 and the bottom edge of the hood 47 is in contact with the seal 21 by pressurizing. The pressurizing between the hood 47 and the seal 21 is performed by the tightening of the fastening screw 9. By compressing the seal 21 with the hood 47, the waterproof and airproof performance around the through hole 32 is maintained.

The method of assembly of the antenna apparatus 1 and the cabinet 10 will be described.

First, the circuit substrate 5 is held standing on the top face of the base 3 to insert the front edge section 51 of the circuit substrate 5 between the rib 62 and rib 62 and to insert the rear edge section 54 of the circuit substrate 5 between the rib 66 and rib 66.

Next, the convex section 8 of the base 3 is fitted to the gasket 2, and the gasket 2 is placed on the top face of the base 3 around the convex section 8. At this time, the position of the gasket 2 in the circumferential direction is adjusted to place the elastic section 22 on the rib 62 and the front edge section 51 of the circuit substrate 5 and to place the elastic section 23 on the rib 66 and the rear edge section 54 of the circuit substrate 5 to fit the mount 31 to the seal 21 to place the seal 21 around the mount 31. The elastic pieces 22 and 23 and seal 21 are integrated with the gasket 2 and thus when the gasket 2 is set, the position of the elastic pieces 22 and 23.and the seal 21 are also set. Therefore, the ease of assembly is enhanced.

Next, the circuit substrate 5 is covered from the top with the cover 4, and the base 3 is fitted into the bottom opening of the cover 4. With this, the gasket 2 is nipped between the stepped section 41 on the inner side of the cover 4 and the base 3, the elastic piece 22 is nipped between the front edge section 51 of the circuit substrate 5 and the pressurizing section 43, the elastic piece 23 is nipped between the rear edge section 55 of the circuit substrate and the pressurizing section 44, and the seal 21 is nipped between the bottom edge of the hood 47 and the top face of the base 3. By fitting the base 3 into the bottom opening of the cover 4, the top edge section of the circuit substrate 5 is supported by the supporting section 46 and the terminal 58 is in contact with the support fitting 45. Also, the tip of the screw fastening section 42 points to the upper side opening of the through hole 32.

Next, the fastening screw 9 is passed through the through hole 32 from under the base 3 and the fastening screw 9 is tightened to the screw fastening section 42. For example, a tapping screw is used as the fastening screw 9, and by screwing the fastening screw 9 to the screw fastening section 42, a female screw is formed on the inner face of the screw fastening section 42 and tightened. With this, the cover 4 is pulled to the top face of the base 3 and the elastic pieces 22 and 23, seal 21 and gasket 2 are compressed and the tip of the screw fastening section 42 is inserted in the top opening of the through hole 32 to be in contact with the circular cone face 33. The hood 47 is in contact with the seal 21 by pressurizing to seal around the fastening screw 9 and the stepped section 41 is in contact with the gasket 2 by pressurizing to seal the gap between the bottom edge section of the cover 4 and the top face of the base 3. The edge sections 51 and 54 of the circuit substrate 5 are pressed to the base 3 by the pressurizing sections 43 and 44 to fix the bottom section of the circuit substrate 5.

Then, the antenna element is mounted to the support fitting 45 and the antenna apparatus 1 is completed.

When the antenna apparatus 1 is mounted on an installing point such as a roof of an automobile, etc., a hole section is made on the installing face to insert the inserting section 6 into the hole section to place the base 3 on the installing face and the inserting section 6 is fixed to the hole section.

As described above, according to the present embodiment, the head 92 of the fastening screw 9 is caught by the bottom face of the base 3 and pulls the base 3 toward the cover 4 side, and thus both the gasket 2 and the seal 21 can be compressed with strong force. In other words, the tightening force of the fastening screw 9 is not reduced and is used to compress the gasket 2 and the seal 21. Therefore, the waterproof and airproof performance of the through hole 32 is not reduced, and the waterproof and airproof performance of the gap between the cover 4 and the base 3 is not reduced.

Also, since the seal 21 is integrally formed with the gasket 2, the waterproof and airproof performance of the through hole 32 is obtained. Therefore, when the apparatus is assembled, a step of applying silicon rubber in a liquid form around the through hole 32 and then drying the silicon rubber is not necessary. Therefore, the cost and time of assembly can be reduced.

Incidentally, the present invention is not limited to the above described embodiments, and various modifications and variation in design can be performed without leaving the scope of the invention.

Figure 4:
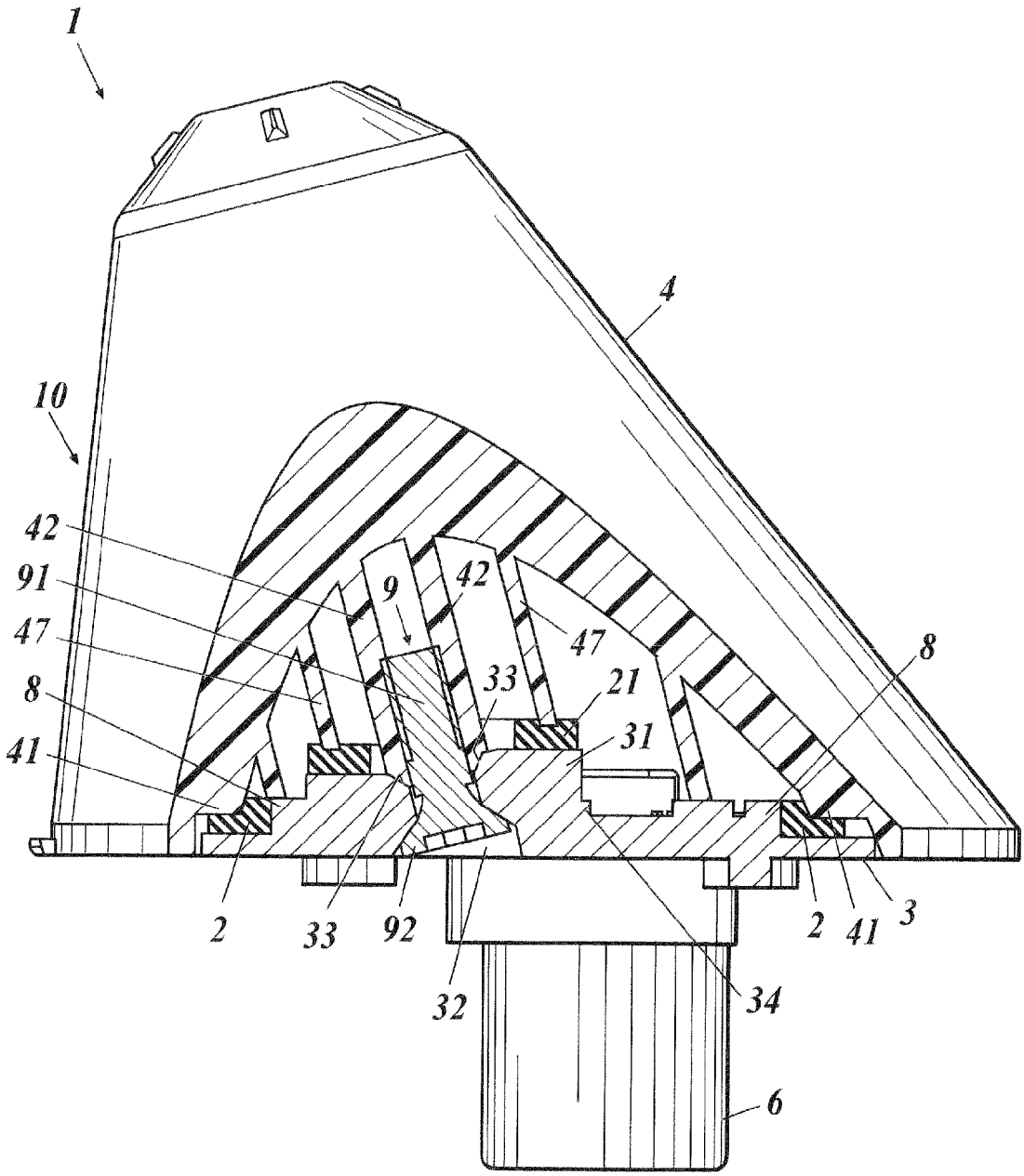
FIG. 4 is a vertical cross-sectional view showing a modification of the antenna apparatus of the present embodiment.
Figure 5:
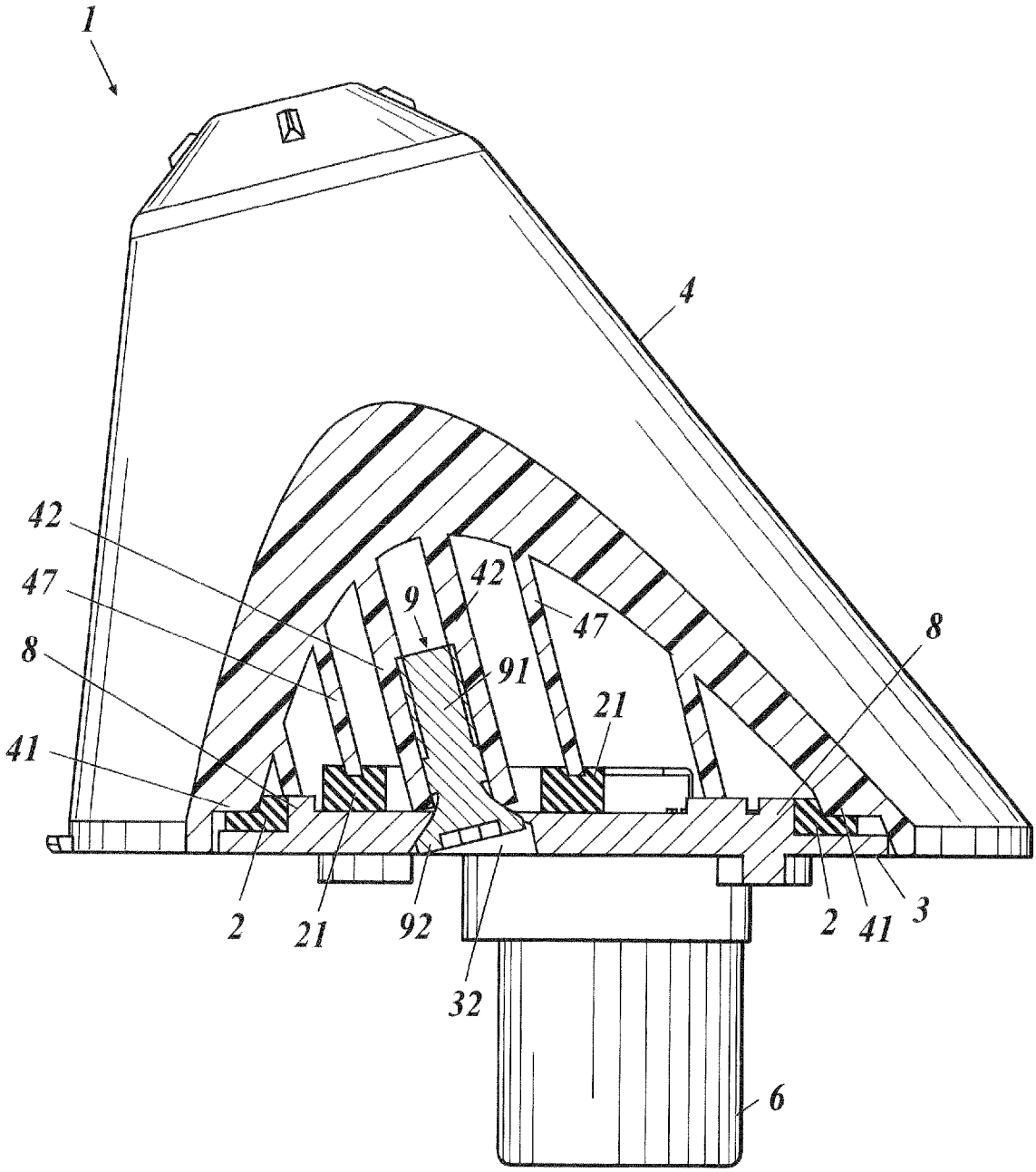
FIG. 5 is a vertical cross-sectional view showing another modification of the antenna apparatus of the present embodiment.
Figure 6:
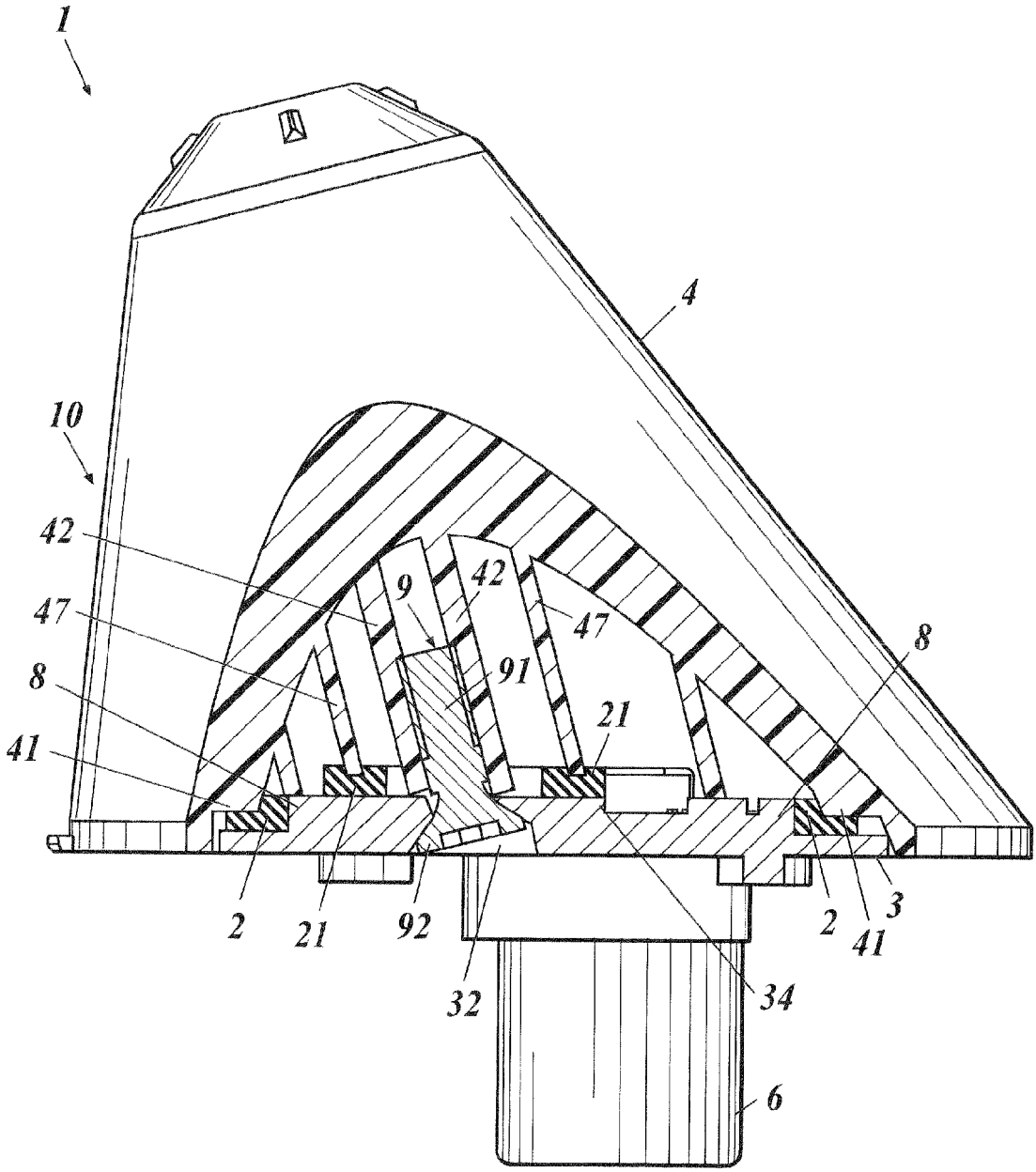
FIG. 6 is a vertical cross-sectional view showing another modification of the antenna apparatus of the present embodiment.

For example, in the present embodiment, the seal 21 is placed on the raised section 34. Alternatively, as shown in FIG. 4, the seal 21 can be placed on the mount 31. Also, as shown in FIG. 5, the mount 31 and the raised section 34 do not have to be provided. Also, as shown in FIG. 6, the mount 31 does not have to be provided.

In the above-described embodiment, the fastening section is a male screw. Alternatively, the fastening section can be a rivet. In this case, instead of the screw fastening section 42 shown in FIG. 3, a rivet is formed on the inner face of the cover 4 and the rivet extends downward from the inner face of the cover 4. The rivet penetrates through the through hole 32 from the top to the bottom and the tip of the rivet is crimped. The tip of the rivet is deformed so that the tip is caught by the bottom face of the base 3 around the through hole 32. When the rivet is crimped, the base 3 is pressed to the cover 4 side and the gasket 2, seal 21 and the elastic pieces 22 and 23 are compressed.

According to an aspect of the preferred embodiments of the present invention there is provided a cabinet of an electrical apparatus including:

a base;

a cover to cover over the base;

a gasket placed on a top face of the base and nipped between a bottom edge section of the cover and the base;

a fastening section to penetrate through the base from a bottom face to the top face of the base to connect an inner face of the cover and to tighten so that the base is pulled to a cover side;

a seal integrally formed with the gasket to surround on the top face of the base a through hole which the fastening section penetrates; and a hood provided on an inner face of the cover so as to surround a connecting portion of the fastening section and the cover, and the hood being pressed against the seal.

According to another aspect of the preferred embodiments of the present invention there is provided an antenna apparatus including:

a base;

a cover to cover over the base;

a gasket placed on a top face of the base and nipped between a bottom edge section of the cover and the base;

a circuit substrate to be accommodated in an inner space surrounded by the base and the cover;

a fastening section to penetrate through the base from a bottom face to the top face of the base to connect to an inner face of the cover and to tighten so that the base is pulled to a cover side;

a seal integrally formed with the gasket to surround on the top face of the base a through hole which the fastening section penetrates; and a hood provided on an inner face of the cover so as to surround a connecting portion of the fastening section and the cover, and the hood being pressed against the seal.

According to these aspects, the gasket is nipped between the bottom edge section of the cover and the base, and the waterproof performance and the airproof performance of the gap between the cover and the base can be enhanced. Also, the seal is provided on the top face of the base so as to surround the through hole penetrating the fastening section, and the hood is provided so as to surround the linking section between the fastening section and the cover and the hood is pressed to the seal so that the waterproof and airproof performance of the through hole of the fastening section can be enhanced.

Then, the fastening section is caught by the bottom face of the base and the base is pulled toward the cover to compress both the gasket and the seal with strong force. Therefore, the waterproof and airproof performance of the through hole of the fastening section is not decreased, and the waterproof and airproof performance of the gap between the cover and the base is not decreased.

Also, since the gasket and seal are integrally formed, when the gasket is set on the top face of the base in assembly, the seal can also be set and the cost and time necessary for assembly can be reduced.

Preferably, the cabinet of the electrical apparatus further includes:

a screw fastening section extending from the inner face of the cover to the through hole, and the screw fastening section being surrounded by the hood, wherein the fastening section is a male screw where a shaft of the male screw passes through the through hole to be screwed to the screw fastening section and a head of the male screw is caught by the bottom face of the base; and an opening of the through hole of a top face side of the base opens widening in a cone shape and a tip of the screw fastening section is inserted in the opening of the through hole of the top face side of the base to be in contact with a cone shaped face of the opening.

Preferably, the antenna apparatus further includes:

a screw fastening section extending from the inner face of the cover to the through hole, and the screw fastening section being surrounded by the hood, wherein the fastening section is a male screw where a shaft of the male screw passes through the through hole to be screwed to the screw fastening section and a head of the male screw is caught by the bottom face of the base; and an opening of the through hole of a top face side of the base opens widening in a cone shape and a tip of the screw fastening section is inserted in the opening of the through hole of the top face side of the base to be in contact with a cone shaped face of the opening.

According to these aspects, the tip of the screw fastening section is inserted in the opening of the through hole and is in contact with the cone shaped face of the opening, and thus the waterproof and airproof performance of the through hole of the fastening section can be enhanced. Also, the positioning performance of the cover and the base can be enhanced.

According to the above-described aspects, waterproof and airproof performance of both the through hole of the fastening section and the gap between the cover and the base can be obtained.

The entire disclosure of Japanese Patent Application No. 2008-309594 filed on Dec. 4, 2008 including description, claims, drawings and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A cabinet of an electrical apparatus comprising:

a base;

a cover to cover over the base;

a gasket placed on a top face of the base and nipped between a bottom edge section of the cover and the base;

a fastening section to penetrate through the base from a bottom face to the top face of the base to connect to an inner side of the cover and to tighten so that the base is pulled to a cover side;

a seal integrally formed with the gasket to surround on the top face of the base a through hole which the fastening section penetrates; and a hood provided on an inner face of the cover so as to surround a connecting portion of the fastening section and the cover, and the hood being pressed against the seal.

2. The cabinet of the electrical apparatus according to claim 1, further comprising:

a screw fastening section extending from the inner face of the cover to the through hole, and the screw fastening section being surrounded by the hood, wherein the fastening section is a male screw where a shaft of the male screw passes through the through hole to be screwed to the screw fastening section and a head of the male screw is caught by the bottom face of the base; and an opening of the through hole of a top face side of the base opens widening in a cone shape and a tip of the screw fastening section is inserted in the opening of the through hole of the top face side of the base to be in contact with a cone shaped face of the opening.

3. An antenna apparatus comprising:

a base;

a cover to cover over the base;

a gasket placed on a top face of the base and nipped between a bottom edge section of the cover and the base;

a circuit substrate to be accommodated in an inner space surrounded by the base and the cover;

a fastening section to penetrate through the base from a bottom face to the top face of the base to connect to an inner side of the cover and to tighten so that the base is pulled to a cover side;

a seal integrally formed with the gasket to surround on the top face of the base a through hole which the fastening section penetrates; and a hood provided on an inner face of the cover so as to surround a connecting portion of the fastening section and the cover, and the hood being pressed against the seal.

4. The antenna apparatus according to claim 3, further comprising:

a screw fastening section extending from the inner face of the cover to the through hole, and the screw fastening section being surrounded by the hood, wherein the fastening section is a male screw where a shaft of the male screw passes through the through hole to be screwed to the screw fastening section and a head of the male screw is caught by the bottom face of the base; and an opening of the through hole of a top face side of the base opens widening in a cone shape and a tip of the screw fastening section is inserted in the opening of the through hole of the top face side of the base to be in contact with a cone shaped face of the opening.

* * * * *